US009741189B2

(12) United States Patent
Ribbe et al.

(10) Patent No.: US 9,741,189 B2
(45) Date of Patent: Aug. 22, 2017

(54) UTILITY CART WITH ELECTRONIC LOCK CABINET

(71) Applicant: Geerpres, Inc., Muskegon, MI (US)

(72) Inventors: Scott E. Ribbe, West Olive, MI (US); William C Vanderlinde, Muskegon, MI (US)

(73) Assignee: Geerpres, Inc., Muskegon, MI (US)

( * ) Notice: Subject to any disclaimer, the term of this patent is extended or adjusted under 35 U.S.C. 154(b) by 41 days.

(21) Appl. No.: 14/858,879

(22) Filed: Sep. 18, 2015

(65) Prior Publication Data

US 2017/0084103 A1 Mar. 23, 2017

(51) Int. Cl.

| | |
|---|---|
| ***E05B 41/00*** | (2006.01) |
| ***G07C 9/00*** | (2006.01) |
| ***E05B 47/00*** | (2006.01) |
| ***E05B 65/44*** | (2006.01) |
| ***E05F 15/60*** | (2015.01) |
| ***E05F 15/75*** | (2015.01) |

(52) U.S. Cl.

CPC ..... *G07C 9/00706* (2013.01); *E05B 41/00* (2013.01); *E05B 47/0046* (2013.01); *E05B 65/44* (2013.01); *E05F 15/60* (2015.01); *E05F 15/75* (2015.01); *G07C 9/00309* (2013.01); *G07C 2009/00388* (2013.01)

(58) Field of Classification Search

CPC ..... G07C 9/00706; G07C 9/00309; G07C 2009/00388; E05F 15/60; E05F 15/75; A47B 81/00; A47B 96/00; E05B 41/00; E05B 47/0046; E05B 65/44; B62B 3/00; G07G 1/009

USPC ..... 280/47.34

See application file for complete search history.

(56) References Cited

U.S. PATENT DOCUMENTS

| | | | | |
|---|---|---|---|---|
| 931,826 | A * | 8/1909 | Werstad | A47B 81/00 220/500 |
| 3,994,505 | A * | 11/1976 | Balha | B62B 3/1404 188/21 |
| 5,924,921 | A * | 7/1999 | Yang | A47B 81/00 312/213 |
| 6,085,560 | A | 7/2000 | Dalton, Jr. | |
| 6,357,806 | B1 * | 3/2002 | Saku | B64D 11/0007 292/140 |
| 7,145,434 | B2 | 12/2006 | Mlynarczyk et al. | |
| 7,225,980 | B2 * | 6/2007 | Ku | G06K 7/0008 235/383 |

(Continued)

OTHER PUBLICATIONS

KTC Keyless Entry System-Passage Mode,Snap-on, pp. 1-10.

*Primary Examiner* — J. Allen Shriver, II
*Assistant Examiner* — Brian Cassidy
(74) *Attorney, Agent, or Firm* — Mitchell Intellectual Property Law, PLLC

(57) ABSTRACT

A utility cart includes a cabinet with a latch and strike lock, which is unlocked in the presence of a passive near field RFID key device and held open by a latch controller for sufficient time to allow the user to open the unlocked cabinet door. The latch is biased to its locking position, to which it returns when released by the controller. The latch includes a ramp surface which is engaged by the leading edge of the strike as the cabinet door is closed. In this way, the strike pushes the latch out of the way as it passes over the end of the latch, and the biased latch then returns to its locking position engaging a keeper in the strike as the keeper passes into position opposite the latch.

20 Claims, 11 Drawing Sheets

(56) References Cited

U.S. PATENT DOCUMENTS

| | | | | |
|---|---|---|---|---|
| 8,360,447 | B2 * | 1/2013 | Knoppers | A47B 31/00 280/47.34 |
| 8,465,030 | B2 * | 6/2013 | Boivin | B62B 3/003 280/47.34 |
| 8,516,864 | B2 | 8/2013 | Greiner et al. | |
| 8,596,655 | B2 * | 12/2013 | Belanger | B29C 65/483 156/92 |
| 8,690,170 | B2 * | 4/2014 | Belanger | B29C 70/86 280/47.34 |
| 8,742,889 | B2 | 6/2014 | Kaczmarz et al. | |
| 8,970,344 | B2 | 3/2015 | Payson et al. | |
| 9,016,701 | B2 * | 4/2015 | Allen | A45C 5/14 280/47.34 |
| 9,033,278 | B2 * | 5/2015 | Van Loon | A47B 31/00 186/45 |
| 2005/0285360 | A1 * | 12/2005 | Helin | A47B 31/00 280/47.34 |
| 2006/0108757 | A1 * | 5/2006 | Brookmire | B62B 3/006 280/47.34 |
| 2008/0196458 | A1 * | 8/2008 | Lu | E05B 47/0012 70/257 |
| 2015/0048625 | A1 * | 2/2015 | Weusten | E05B 47/023 292/137 |
| 2016/0121914 | A1 * | 5/2016 | Fodrocy | B62B 3/004 280/47.34 |
| 2016/0185375 | A1 * | 6/2016 | Yu | B62B 3/146 224/411 |
| 2016/0240023 | A1 * | 8/2016 | Toivonen et al. | G07C 9/00309 |
| 2016/0255928 | A1 * | 9/2016 | O'Donnell | A45C 5/03 |
| 2016/0290023 | A1 * | 10/2016 | Boivin | E05C 9/046 |
| 2016/0340943 | A1 * | 11/2016 | Sharp | E05C 1/02 |

* cited by examiner

UTILITY CART WITH ELECTRONIC LOCK CABINET

FIELD OF THE INVENTION

The present invention relates to the field of utility carts.

BACKGROUND OF THE INVENTION

Utility carts typically comprise a wheeled base, a handle, and a set of shelves and/or cabinet in which chemicals, cleaning supplies and other tools can be kept. The cabinets often include a lock which can be unlocked and relocked by means of a key carried by the user of the cart.

SUMMARY OF THE INVENTION

The utility cart of the present invention includes a cabinet with a latch and strike lock, which is unlocked in the presence of a passive near field RFID key device, and held open by a latch controller for sufficient time to allow the user to open the unlocked cabinet door. The latch is biased to its locking position, to which it returns when released by the controller. The latch includes a ramp surface which is engaged by the leading edge of the strike as the cabinet door is closed. In this way, the strike pushes the latch out of the way as it passes over the end of the latch, and the biased latch then returns to its locking position engaging a keeper in the strike as the keeper passes into position opposite the latch.

These and other objects, advantages and features of the invention will be more fully appreciated by reference to the written description of the preferred embodiments, the claims and the appended drawings.

DESCRIPTION OF THE PREFERRED EMBODIMENT

Figure 1:
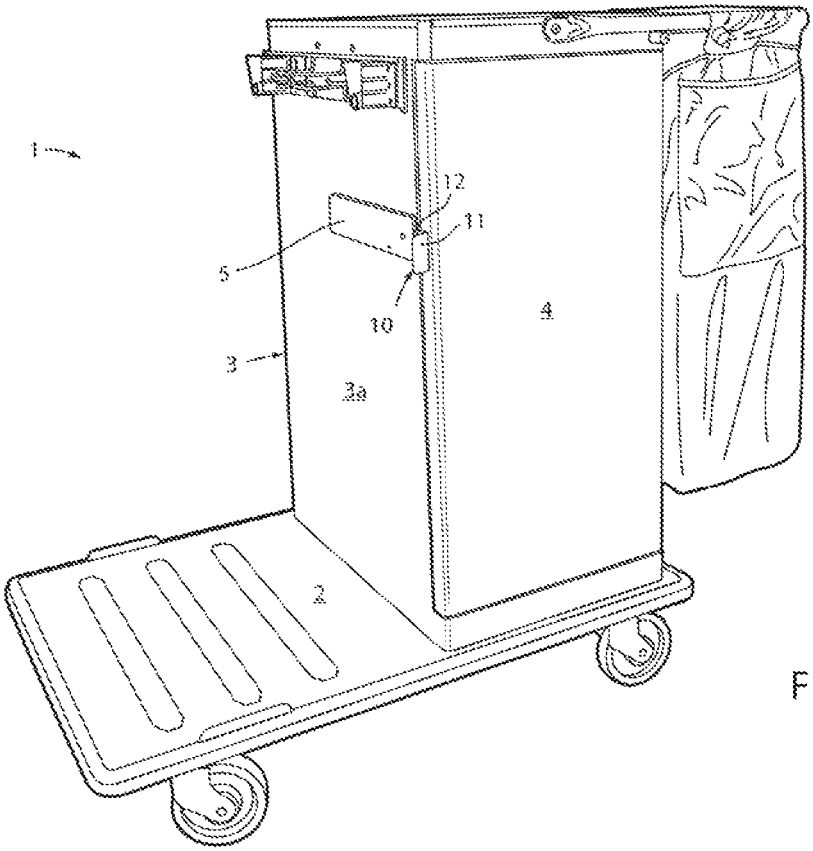
FIG. 1 is a partial perspective view of the utility cart of the preferred embodiment.
Figure 2:
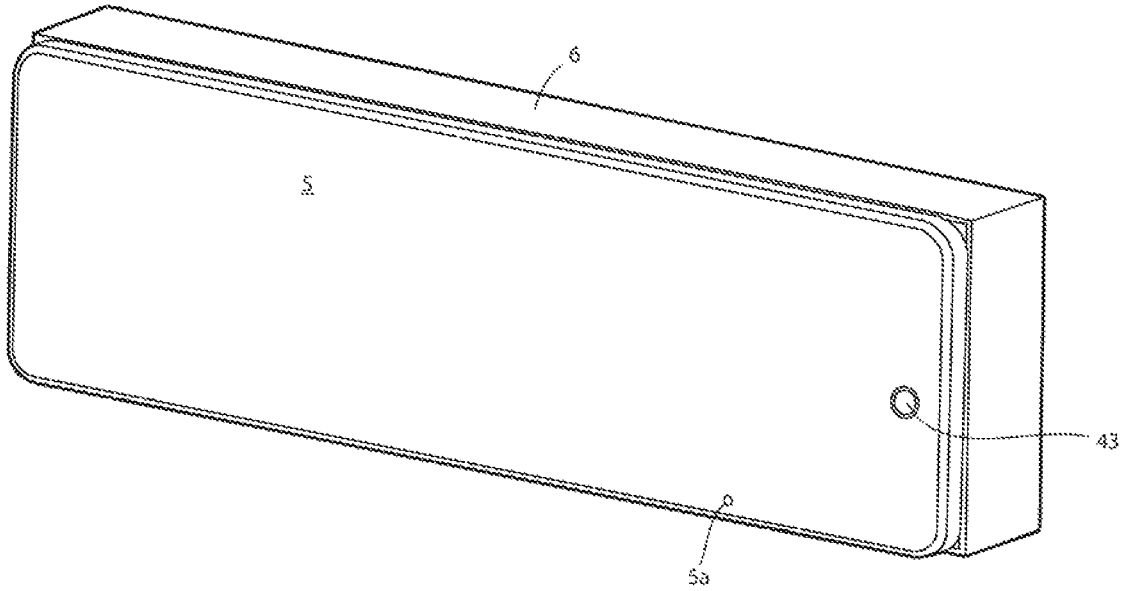
FIG. 2 is a perspective view of the covered latch and lath controller housing.
Figure 3:
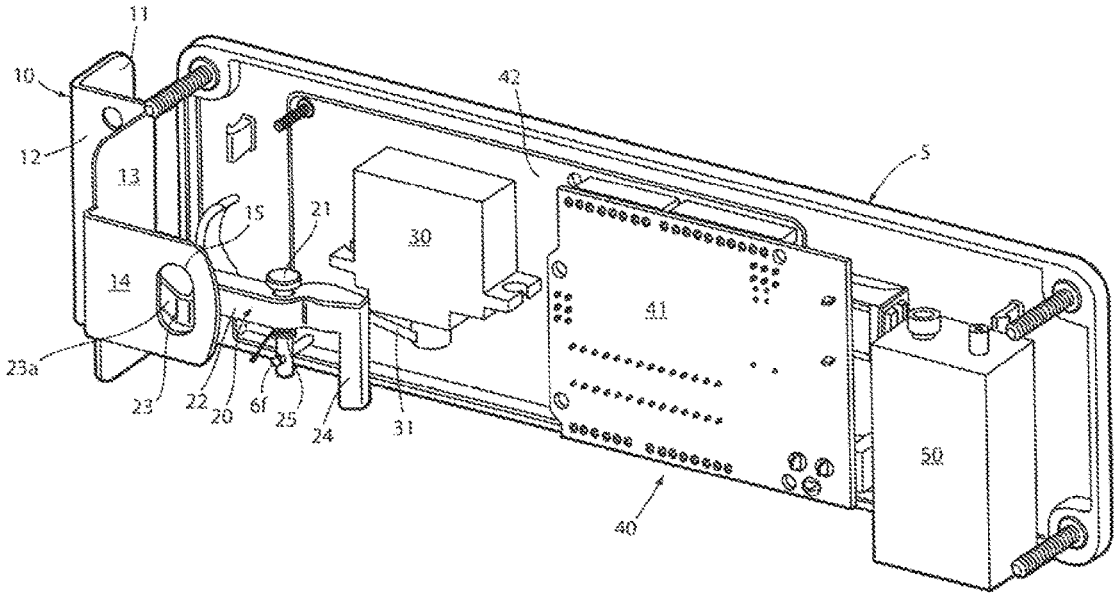
FIG. 3 is a perspective view of the interior of the latch and controller housing and the housing cover, with the housing removed and with the door handle and strike shown in their locked position by engagement with said latch.
Figure 4:
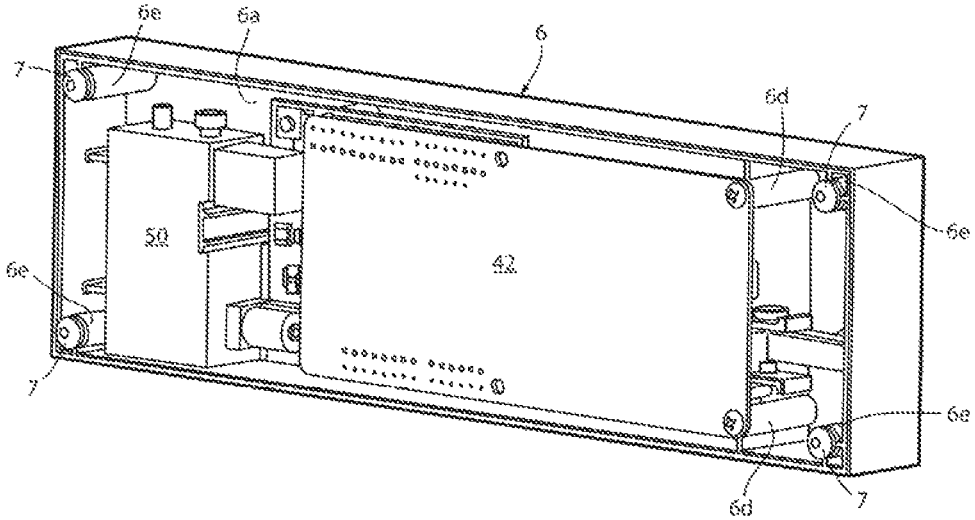
FIG. 4 is a view of the latch and controller housing and its contents, with the housing cover removed.
Figure 5:
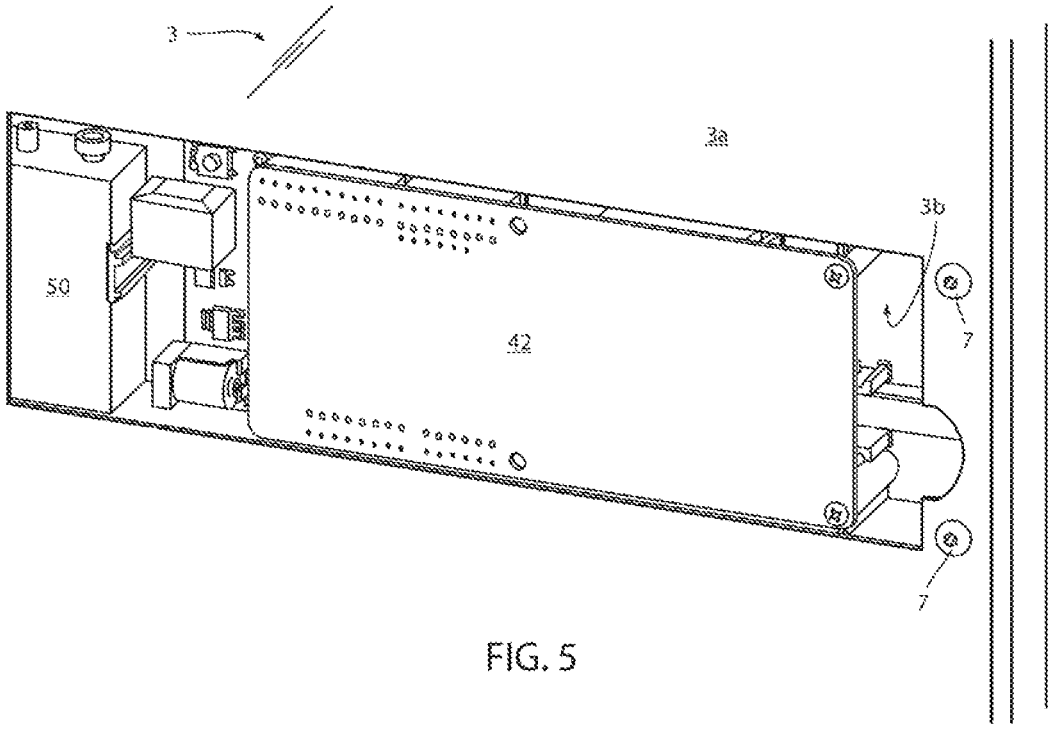
FIG. 5 is a perspective view of the side wall of the cart cabinet, showing the opening therein, which exposes the open interior of the latch and controller housing and its contents.
Figure 10:
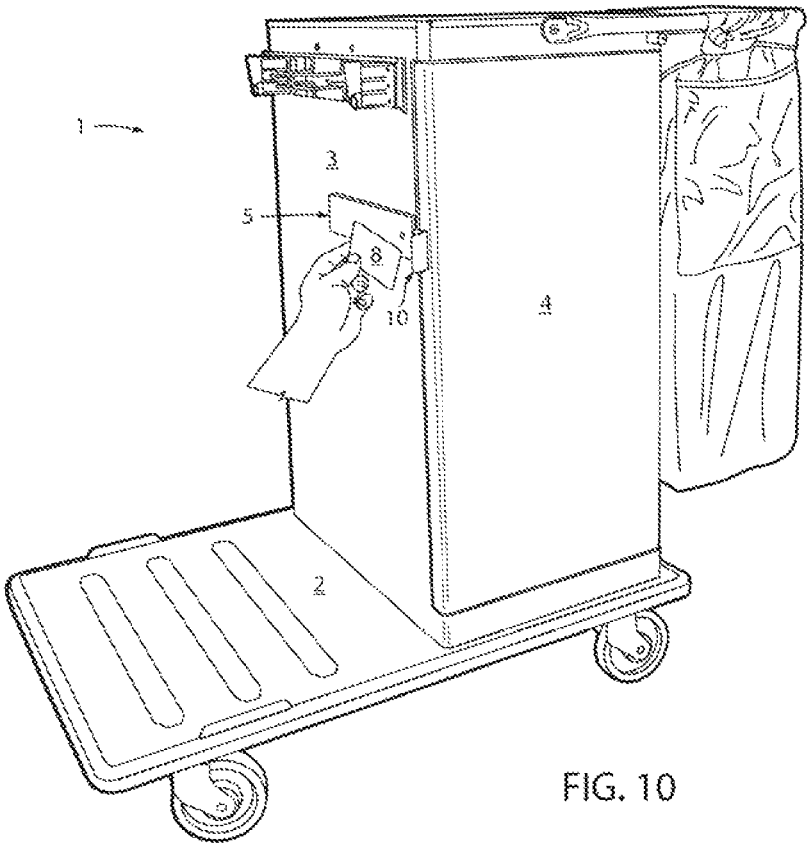
FIG. 10 is a perspective view showing a near field RFID key card being positioned near the antenna of said latch controller.

Table 1 below lists the components of the preferred embodiments. Utility cart 1 includes a wheeled platform 2 and a cabinet 3 having a hinged cabinet door 4 (FIG. 1). A handle and strike member 10 is secured to the edge of door 4 (FIGS. 1, 10). A housing 6 containing a latch 20, latch actuator 30, controller 40 and a battery 50 is secured to the inside of cabinet sidewall 3*a*, adjacent an opening 3*b* (FIGS. 3-5). A cover plate 5 is fitted to the sidewall of cabinet 3 to cover opening 3*a*, and to cover the open side of housing 6 (FIGS. 1, 2). Controller 40 comprises a micro controller board 41 operably attached to an antenna board 42 which is located adjacent opening 3*b* in sidewall 3*a* of cabinet 3 (FIGS. 4, 5), and is covered by cover plate 5 (FIGS. 1, 2). To open door 4 of cabinet 3, one places a near field RFID card 8 adjacent cover plate 5. This allows communication with antenna 42 which causes the micro controller board 41 to activate actuator 30, releasing latch 20 and holding it for sufficient time to allow a user to open door 4 using handle 10 as shown in FIGS. 10 and 11.

TABLE 1

| Component Listing | |
|---|---|
| Cart | 1 |
| Wheeled base | 2 |
| Cabinet | 3 |
| Cabinet door | 4 |
| Cover plate | 5 |
| Pin hole | 5a |
| Controller/latch housing | 6 |
| Inside wall | 6a |
| Detent aperture | 6b |
| Slot opening | 6c |
| Antenna mounts | 6d |
| Cover plate mounts | 6e |
| Pivot mount peg | 6f |
| Fasteners | 7 |
| RFID key card | 8 |
| Handle/Strike | 10 |
| Handle flange | 11 |
| Handle mount | 11 |
| Spacer flange | 13 |
| Strike | 14 |
| Keeper | 15 |
| Latch | 20 |
| Pivot pin | 21 |
| Latch arm | 22 |
| Detent | 23 |
| Detent ramp | 23a |
| Detent locking ramp | 23b |
| Tail | 24 |
| Bias spring | 25 |
| Actuator | 30 |
| Actuator arm | 31 |
| Controller | 40 |
| microcontroller board | 41 |
| Antennae board | 42 |
| Led indicator | 43 |
| Battery | 50 |

Figure 6:
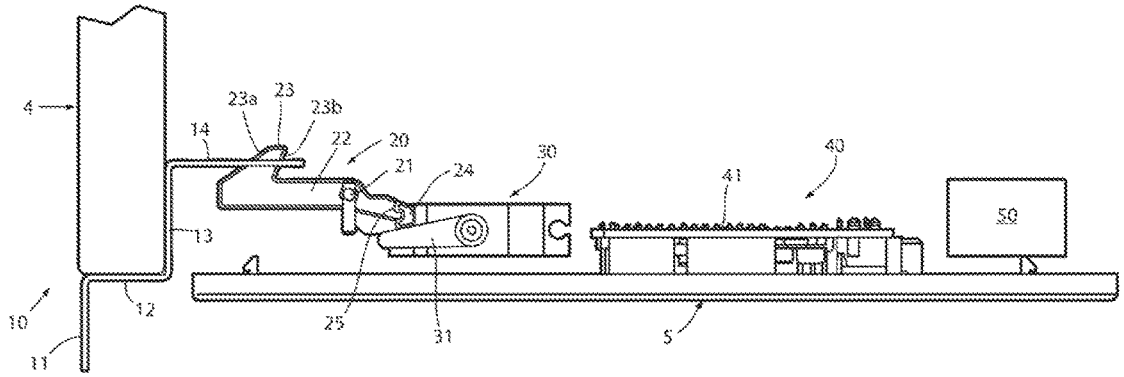
FIG. 6 is a plan view of the latch controller, door and strike mechanism, with the housing removed and without showing the cabinet.
Figure 11:
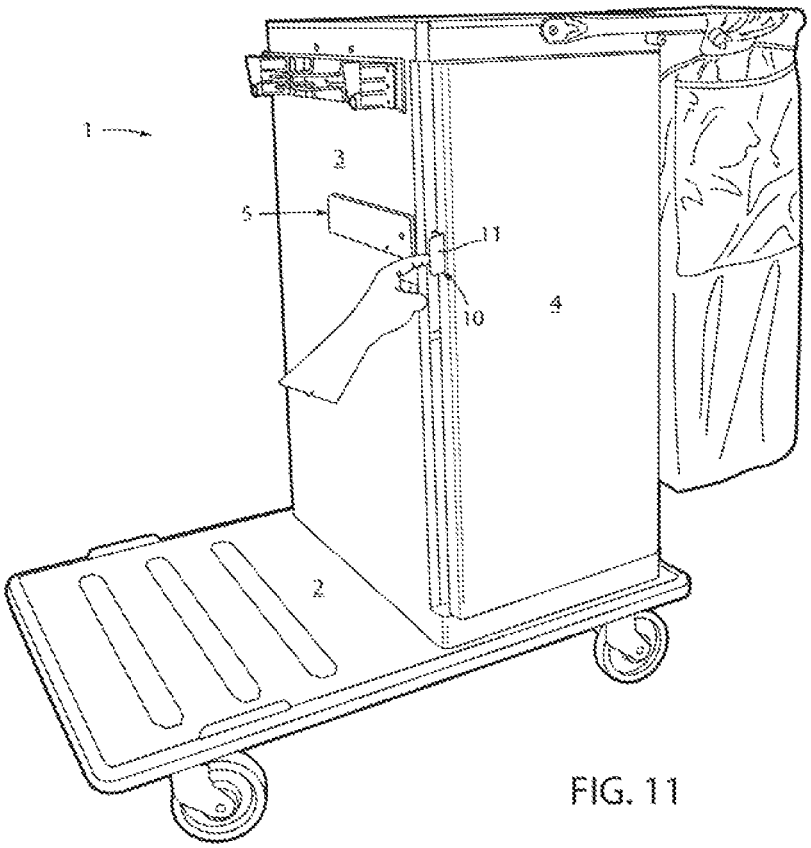
FIG. 11 is a perspective view of the cabinet door being opened.

Handle and strike 10 is preferably bent from a piece of metal and comprises a handle flange 11 which a person engages to open door 4 (FIGS. 1, 3 & 11). Flange 11 extends at right angles from a flange 12 which is secured to the edge of cabinet door 4 (FIGS. 1, 6). Flange 13 extends from mounting flange 12 at right angles and is also secured to cabinet door 4 on the inside surface thereof (FIG. 6). Finally, strike flange 14 extends perpendicularly from flange 13 and includes a keeper opening 15 therein (FIGS. 3, 6).

Housing 6 is an open sided tray like housing, comprising a perimeter edge wall and an inside wall 6*a*. The various components contained in housing 6 are directly or indirectly mounted to inside wall 6*a* of housing 6 (FIG. 4). Corner bosses 6*e* facilitate the mounting of housing 6 to the sidewall 3*a* of cabinet 3, using fasteners 7 (FIGS. 4, 5). Housing 6 is secured to the inside of cabinet side wall 3*a*, such that the open side of housing 6 faces the opening 3*b* in cabinet side wall 3*a* (FIG. 4).

Figure 7:
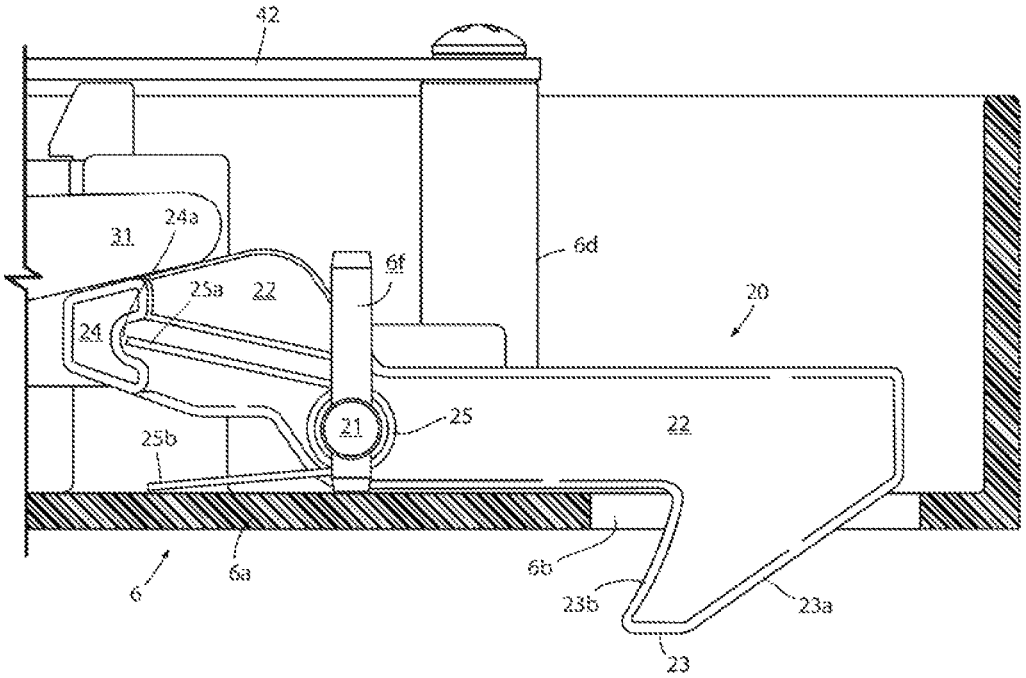
FIG. 7 is a fragmentary plan view of the latch mechanism.
Figure 8:
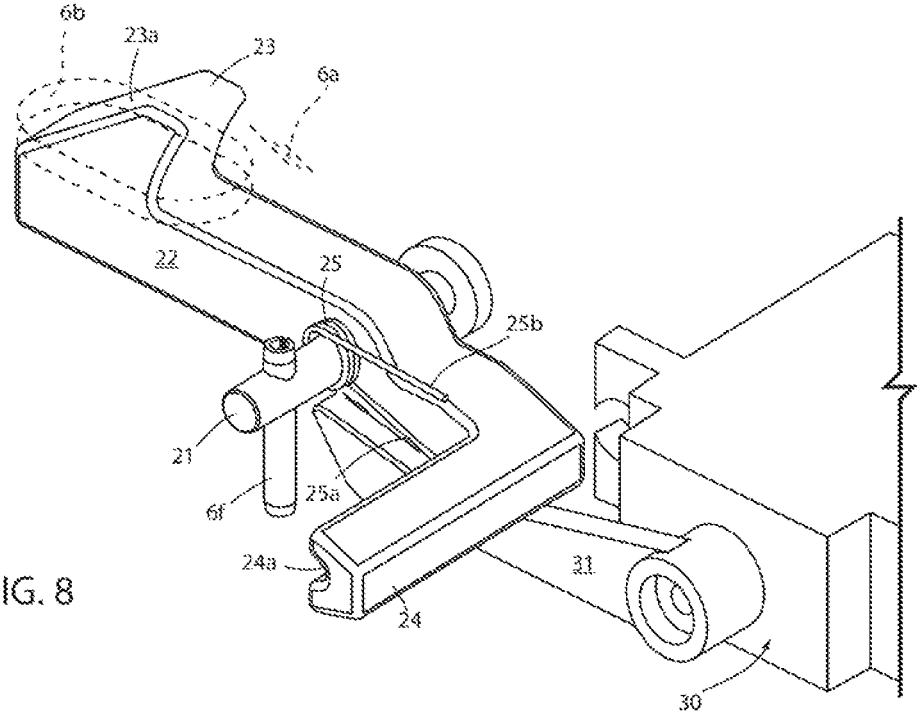
FIG. 8 is a fragmentary perspective view of the latch mechanism.

Latch 20 is pivotally mounted on pivot pin 21 which is fixedly mounted within housing 6, on peg 6*f* which projects from housing inside wall 6*a* (FIGS. 3, 8). Latch 20 includes a horizontal arm 22 which pivots about pivot pin 21, and includes a detent member 23 projecting from one end thereof for engagement with keeper aperture 15 (FIGS. 3, 6). Arm 22 extends from detent 23 past pivot pin 21 to a downwardly depending tail 24 (FIGS. 3, 6, 7 & 8).

Latch 20 is normally biased into its locking position by bias spring 26. Bias spring 25 coils around pivot pin 21 and includes an extending leg 25*a*, the end of which is seated in a groove 24*a* in the downwardly extending tail 24 of pivot arm 12 (FIGS. 3, 7 & 8). After wrapping around pivot pin 21, another extending leg 25*b* rests against the inside of inside wall 6*a* of housing 6, thereby biasing latch 20 such that its detent end 23 projects through an aperture 6*b* in inside wall 6*a* of housing 6 (FIG. 7). Referring to FIG. 8, it can be seen that during assembly, projecting leg 25*b* actually extends through a slot opening 6*c* in inside wall 6*a* of housing 6. During assembly, leg 25*b* is tucked down through slot opening 6*c* and is pushed to the side of slot 6*c* so that it engages the inside of inside wall 6*a*. When strike 14 is in its locking position, detent end 23 is also biased to extend into keeper opening 15, thereby locking cabinet door 4 (FIGS. 3, 6).

Latch actuator 30 is a servo motor which includes a pivotally moving arm 31. Arm 31 engages tail 24 of latch 20 pivots latch 20, such that detent 23 is pivoted out of keeper aperture 15 in strike plate 14, unlocking door 4. Controller 40 holds arm 31 in its unlocking position long enough for a user to open door 4, as shown in FIG. 11. Actuator 30 is then released, arm 31 retracts, and latch 20 is biased back into its locking position by bias spring 25.

However, door 4 will typically be open when latch 20 returns. To facilitate re-locking of door 4, detent 23 on latch 20 includes an outwardly facing ramp surface 23*a*, which when latch 22 is positioned in its locked position as shown in FIGS. 3 and 6, allows strike plate 14 to slide over ramp surface 23*a* as one is closing door 4, thereby pushing detent 23 away from strike plate 14 and allowing it to pass over the end of detent 23 and be biased back into position within keeper aperture 15 as shown in FIGS. 1 and 6. The inside surface 23*b* of detent 21 is also sloped so as to make an acute angle with respect to arm 22, thereby providing a secure catch of strike plate 14 and making, it very difficult for one to accidentally cause strike plate 14 to be slid over detent 23 when latch 20 is in its locking position.

Controller 40 comprises microcontroller 41 connected to antenna board 42. Antenna board 42 is mounted by suitable fasteners on bosses 6*d* extending from inside wall 6*a* (FIG. 4). When so mounted, antenna board 42 is positioned in front of opening 3*b* in cabinet side wall 3*a* (FIG. 4). This improves the ability of antenna board 42 to communicate with near field RFID card 8.

Figure 9:
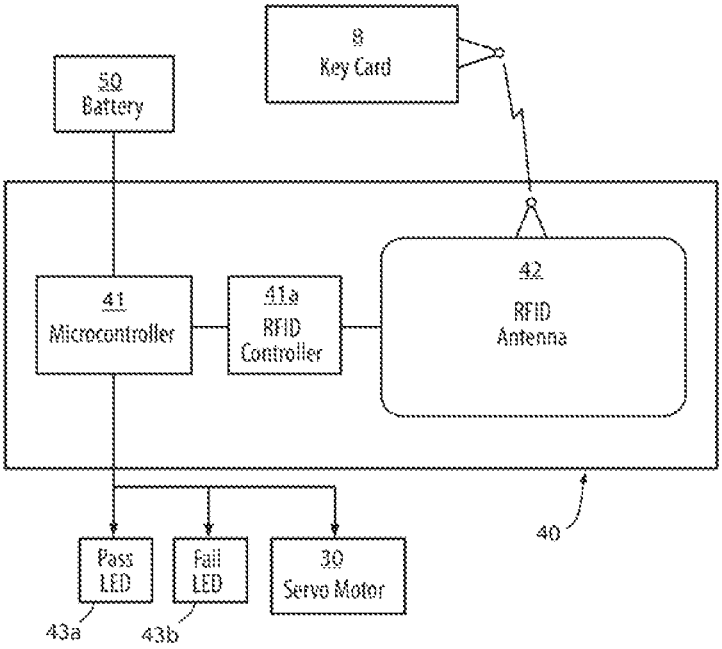
FIG. 9 is a control schematic.

Battery 50 is mounted in housing 6, and can be serviced through a removable covered opening in inside wail 6*a* of housing 6, or by removing cover plate 5, creating access to battery 50 though opening 3*b* in cabinet side wall 3*a* (FIG. 4). Battery 50 is electrically connected to and provides power to microcontroller 41 (FIG. 9). Micro controller 41 provides power to an RFID controller subunit 41*a*, which provides power and instructions to antenna 42, and in turn receives information from antenna 42 which antenna 42 receives from an activated near field RFID key card (FIG. 9). Microcontroller 41 is also electrically connected to and provides instructions to a red/green bi-colored indicator led 43 (FIG. 9), which is visible through a clear lens in cover 5 (FIG. 2). Micro controller is electrically connected to and sends instructions to actuator 30 (FIG. 9).

RFID controller 41*a* instructs antenna 42 to emit a continuous or intermittent signal which will be picked up by a near field RFID card 8 placed in close proximity to antenna 42. If the signal is transmitted intermittently, it must stay "on" sufficiently long to be picked up by a near field RAID card 8 placed in proximity to antenna 42 (FIGS. 9, 10), and to power through induction to coil in card 8 a return coated signal from card 8. RFID card 8 is then powered through induction by the antenna signal, and responds to the antenna signal by sending a coded signal to RFID controller 41*a* through antenna 42. If the coded signal matches the coded information recorded in RFID controller 41*a*, microcontroller 41 causes the bi-colored LED light 43 to glow green (43*a* in FIG. 9), indicating that latch 22 will be unlocked and door 4 can be opened. If the signal from RFID card 8 does not match the code information in RFID controller 41*a*, microcontroller 41 causes bi-colored LED light 43 to glow red (43*b* in FIG. 9), indicating that latch 22 is not in its unlocked position and door 4 cannot be opened. When the RFID controller 41*a* senses a match with the RFID key card, micro controller 41 sends power to servo actuator 30, which rotates servo arm 31 and causes latch 22 to pivot into its unlocking position.

Microcomputer board 42 includes a delay function which holds servo arm 31 and latch 22 in its unlocked position long enough for the user to grasp handle flange 11 and open door 4 (FIG. 11). Preferably, the delay is from about 2 to 10 seconds, more preferably about 2-5 seconds, and most preferably about 3 seconds. The timer circuit then times out and bias spring 25 biases latch 22 back into its locked position, though with door 4 open so that detent 23*a* is not engaging the keeper in strike 14.

After completing his work, the user simply closes door 4 such that strike flange 14 slides over ramp 23*a*, pushing latch 22 out of the way, until keeper aperture 15 is located over the end of detent 23, at which point biasing spring 25 forces latch 22 back into its locking position with detent 23 extending through keeper aperture 15.

To accommodate loss of power caused by a dying or faulty battery, cover plate 5 is provided with a pin hole 5*a* (FIG. 2), which is aligned with the tail end 24 of latch arm 22. This allows a user to insert a slender rod and engage and push tail end 24 away, pivoting latch 22 into its opening position.

Of course, it is understood that the foregoing discloses preferred embodiments of the invention, and that various changes and alterations can be made without departing from the breadth and spirit thereof as set forth in the appended claims.

The invention claimed is:

1. A utility cart comprising: a wheeled base and a cabinet, said cabinet including a door which opens and closes to permit or prevent access to the interior of said cabinet; said cabinet including a latch moveable between a locking and unlocking position, said latch being biased to said locking position; said door including a strike having a keeper for receiving a portion of said latch to lock said door against opening; said cabinet including a controller for controlling said latch and causing said latch to move from said locking position to said unlocking position; said controller comprising an RFID controller and an antenna for transmitting an RFID signal; a passive RFID key device which responds to said RFID transmission; said controller causing said latch to move from said locking position to said unlocking position in response to receiving the correct information from said RFID key device, and said controller holding said latch in said unlocking position for sufficient time to allow a user to open the unlocked cabinet door; said controller releasing said latch after said sufficient time, whereby said latch is biased into the locking position of said latch; said latch including a ramp surface which is engaged by said strike as said cabinet door is closed, whereby said strike pushes said latch against the bias of said latch and out of the way as said strike passes over the engaged portion of said latch, and whereby said biased latch then returns to the locking position of said latch engaging said keeper in said strike as said keeper passes into position opposite said latch.

2. The utility cart of claim 1 in which said RFID controller and said RFID key device are near field RFID controllers and devices respectively.

3. The utility cart of claim 1 in which said sufficient time is from about 2 to 10 seconds.

4. The utility cart of claim 1 comprising said latch being pivotally mounted on a pivot and including a detent member projecting therefrom on one side of said pivot for engagement to said keeper, and a tail on the opposite side of said pivot; a latch actuator including a pivot arm for engaging said tail of said latch; said controller causing said latch to move from said locking position of said latch to said unlocking position by causing said actuator to rotate said pivot arm, to thereby rotate said latch from said locking position into said unlocking position.

5. The utility cart of claim 4 in which said latch is normally biased into said locking position of said latch by a bias spring coiled around said pivot and including one end of said spring engaging said latch and another end of said spring being fixed at a point other than on said latch.

6. The utility cart of claim 4 in which said latch, said latch actuator and said controller are housed in a housing secured to an inside wall of said cabinet, wherein said latch is in alignment with said strike as said door is closed.

7. The utility cart of claim 6 in which said housing includes an inside wall joined to a perimeter wall, and an open side; said inside wall including a detent aperture through which said detent projects when said latch is in said locking position; said hosing being positioned such that said keeper in said strike aligns with said detent aperture when said door of said cabinet is closed; said antenna of said controller being located at said open side of said housing; said cabinet inside wall to which said housing is secured having an aperture therein, which is aligned with said antenna when said housing is secured to said inside wall.

8. The utility cart of claim 7 which also includes a battery mounted in said housing and connected so as to provide power to said controller and said latch actuator.

9. The utility cart of claim 7 in which said cabinet wall aperture and said antenna are covered by a cover on the exterior side of said cabinet wall.

10. The utility cart of claim 9 which includes a bi-functional indicator which shows one condition when said RFID key device communicates the correct information to said controller, thus indicating that said door is unlocked, and shows another condition when said RFID key device communicates the incorrect information to said controller, thus indicating that said door remains locked; said bi-functional indicator being positioned to be visible through an indicator opening in said cover.

11. The utility cart of claim 4 in which said RFID controller and said RFID key device are near field RFID controllers and devices respectively.

12. The utility cart of claim 4 in which said sufficient time is from about 2 to 10 seconds.

13. The utility cart of claim 1 in which said latch, said latch actuator and said controller are housed in a housing secured to an inside wall of said cabinet, wherein said latch is in alignment with said strike as said door is closed.

14. The utility cart of claim 13 in which said housing includes an inside wall joined to a perimeter wall, and an open side; said antenna of said controller being located at said open side of said housing; said cabinet inside wall to which said housing is secured having an aperture therein, which is aligned with said antenna when said housing is secured to said inside wall.

15. The utility cart of claim 14 in which said cabinet wall aperture and said antenna are covered by a cover on the exterior side of said cabinet wall.

16. The utility cart of claim 15 which includes a bi-functional indicator which shows one condition when said RFID key device communicates the correct information to said controller, thus indicating that said door is unlocked, and -a shows another condition when said RFID key device communicates the incorrect information to said controller, thus indicating that said door remains locked; said bi-functional indicator being positioned to be visible through an indicator opening in said cover.

17. The utility cart of claim 1 which includes a bi-functional indicator which shows one condition when said RFID key device communicates the correct information to said controller, thus indicating that said door is unlocked, and -a shows another condition when said RFID key device communicates the incorrect information to said controller, thus indicating that said door remains locked.

18. The utility cart of claim 17 in which said latch, said latch actuator and said controller are housed in a housing secured to an inside wall of said cabinet, wherein said latch is in alignment with said strike as said door is closed.

19. The utility cart of claim 1 in which said strike is a component of a handle and strike member comprising: a handle flange which a person engages to open said cabinet door; said handle flange being joined to a mounting flange which is secured to the edge of said cabinet door; a second mounting flange extends from said mounting flange at right angles and is also secured to said cabinet door on the inside surface thereof; said strike comprising a strike flange extending perpendicularly from said second mounting flange, said keeper comprising a keeper opening in said strike flange.

20. The utility cart of claim 19 comprising said latch being pivotally mounted on a pivot and including a detent member projecting therefrom on one side of said pivot for engagement with said keeper, and a tail on the opposite side of said pivot; a latch actuator including a pivot arm for engaging said tail of said latch; said controller causing said latch to move from its said locking position to said unlocking position by causing said actuator to rotate said pivot arm, to thereby rotate said latch from said locking position into said unlocking position.

* * * * *